United States Patent [19]

Eguchi et al.

[11] Patent Number: 4,985,690

[45] Date of Patent: Jan. 15, 1991

[54] DIELECTRIC STEPPED IMPEDANCE RESONATOR

[75] Inventors: Kazuhiro Eguchi; Eiichi Ochiai; Shinichiro Ito; Takehiko Yoneda; Hiromitsu Taki; Toshiharu Noguchi; Kuniaki Kiyosue; Akiro Yoshida, all of Miyazaki; Morikazu Sagawa, Tama; Mitsuo Makimoto, Yokohama, all of Japan

[73] Assignee: Matsushita Electric Industrial Co., Ltd., Osaka, Japan

[21] Appl. No.: 375,417

[22] Filed: Jul. 5, 1989

[30] Foreign Application Priority Data

Jul. 7, 1988 [JP] Japan ..... 63-170410
Jul. 7, 1988 [JP] Japan ..... 63-170413

[51] Int. Cl.[5] ..... H01P 7/04

[52] U.S. Cl. ..... 333/222; 333/206; 333/219.1

[58] Field of Search ..... 333/219, 219.1, 206, 333/207, 222, 223, 224, 202

[56] References Cited

U.S. PATENT DOCUMENTS 4,506,241 3/1985 Makimoto et al. ..... 333/219.1 X
4,631,506 12/1986 Makimoto et al. ..... 333/207 X
4,733,208 3/1988 Ishikawa et al. ..... 333/206 X
4,795,992 1/1989 Saito et al. ..... 333/222 X

FOREIGN PATENT DOCUMENTS 0172003 10/1983 Japan ..... 333/222
0185404 10/1984 Japan ..... 333/206

*Primary Examiner*—Eugene R. LaRoche
*Assistant Examiner*—Seung Ham
*Attorney, Agent, or Firm*—Stevens, Davis, Miller & Mosher

[57] ABSTRACT

A coaxial dielectric resonator for use at high frequency. The outer or inner peripheral surface of a tubular dielectric member is stepped so as to provide a greater suppression of spurious resonance. The dielectric member has a prism-shaped outer configuration so as to provide a high Q value, as well as improved space factor.

3 Claims, 6 Drawing Sheets

DIELECTRIC STEPPED IMPEDANCE RESONATOR

BACKGROUND OF THE INVENTION

The present invention relates to a coaxial dielectric resonator (referred to as dielectric S.I.R. (Stepped Impedance Resonator) hereinafter) which is used at high frequency.

FIG. 9 shows a typical conventional dielectric S.I.R. This dielectric S.I.R. is composed of a cylindrical outer conductor 1, an inner conductor 2 and a dielectric member 3. The outside diameter of the outer conductor 1 is reduced at the open end of the outer conductor 1 over a predetermined axial length as compared with the closed end of the outer conductor 1 so as to reduce impedance. Another known dielectric S.I.R. is shown in FIG. 10. Both these known dielectric S.I.R.s have cylindrical configurations.

In these known dielectric S.I.R.s, a large reduction of the Q value in the resonance circuit is inevitable, which makes it difficult to reduce the size of the filter in the resonator.

Another problem encountered with the known dielectric S.I.R.s is that the space factor is reduced due to the fact that the filter has to be placed in a case which has a cylindrical configuration.

SUMMARY OF THE INVENTION

Accordingly, an object of the present invention is to provide a dielectric S.I.R. which has a higher value of Q than known dielectric S.I.R.s.

Another object of the present invention is to provide a dielectric S.I.R. which enables the spurious resonance frequency to be set freely and which provides an improved space factor.

To this end, according to one aspect of the invention, there is provided a dielectric stepped impedance resonator comprising: a hollow dielectric member the inside diameter of which is varied at an intermediate portion thereof so as to provide a step, the dielectric member having a prism-form outer configuration; inner and outer conductors covering the inner and outer surfaces of the dielectric member; and a short-circuiting member provided on one end of the dielectric member so as to electrically connect the inner and outer conductors to each other.

According to another aspect of the invention, there is provided a dielectric stepped impedance resonator comprising: a prism-shaped outer conductor; a cylindrical inner conductor disposed in the outer conductor coaxially therewith; a dielectric member disposed between the outer and inner conductors; and a short-circuiting member which electrically connects one end of the outer conductor to the adjacent end of the inner conductor; the end portion of the outer conductor opposite to the short-circuiting member and extending over a predetermined length from the end extremity has a cylindrical or prism form the outer dimension of which is smaller than the outer dimension of the end portion of the outer conductor adjacent to the short-circuiting member.

According to still another aspect of the present invention, there is provided a dielectric stepped impedance resonator comprising: a prism-shaped outer conductor; a cylindrical inner conductor disposed in the outer conductor coaxially therewith; a dielectric member disposed between the outer and inner conductors; and a short-circuiting member through which one end of the outer conductor is electrically connected to the adjacent end of the inner conductor; the end portion of the inner conductor opposite to the short-circuiting member and extending over a predetermined length from the end extremity has a cylindrical or prism form the inner dimension of which is greater than the inner dimension of the end portion of the inner conductor adjacent to the short-circuiting member.

The above and other objects, features and advantages of the present invention will become clear from the following description of the preferred embodiments when the same is read in conjunction with the accompanying drawings.

DESCRIPTION OF THE PREFERRED EMBODIMENTS

A first embodiment of the dielectric S.I.R. of the present invention will be described with reference to the accompanying drawings.

Figure 1:
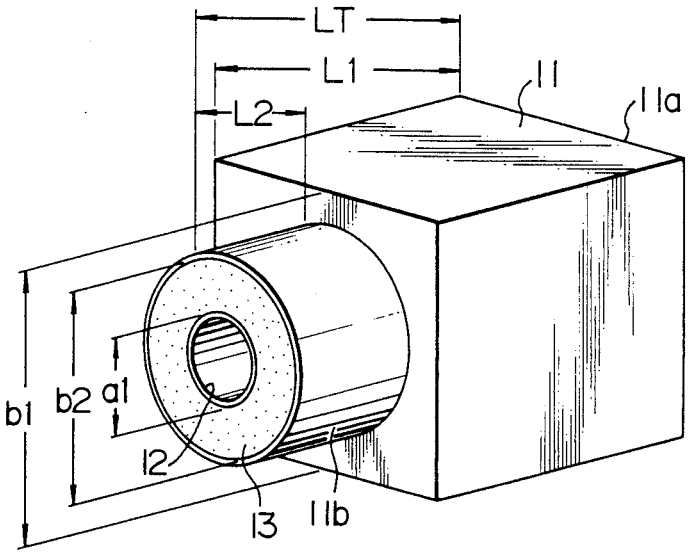
FIG. 1 is a perspective view of an embodiment of a dielectric S.I.R. in accordance with the present invention.

Referring to FIG. 1 showing the first embodiment, an outer conductor 11 has a closed or short-circuited end portion 11*a* which has a prism form and an open end portion 11*b* which has a cylindrical form. The cylindrical open end portion 11*b* has a predetermined axial length and has an outside diameter which is smaller than the length of the side of cross-section of the closed end portion 11*a*. An inner conductor 12 is disposed in the outer conductor 11 coaxially therewith. A dielectric member 13 is disposed in the annular space between the outer and inner conductors 11 and 12. The dielectric member 13 is formed by dry-forming and firing a $BaTi_4O_9$ type ceramic material and shaping the open end portion into a cylindrical form. The outer conductor 11 and the inner conductor 12 are formed by metallizing the outer and inner surfaces of the dielectric member 13 with silver. Thus, the conductors 11 and 12 actually have a film-like form. The outer conductor 11 and the inner conductor 12 are connected to each other at one end of the dielectric member 13.

The outer dimension, length and the impedance of the closed end portion of the thus formed dielectric S.I.R. are represented by $b_1$, $L_1$ and $Z_1$, respectively. The outer diameter, length and the impedance of the open end portion are represented by $b_2$, $L_2$ and $Z_2$, respectively. The overall length of the dielectric S.I.R. is represented by LT.

Using these expressions, the condition of resonance is given as follows:

$$\tan\beta L_1 . \tan\beta L_2 = Z_2/Z_1 = K$$

where, $$Z_1 = 60\ln(1.2b1/a1)/\sqrt{\epsilon_r}$$

$$Z_2 = 60\ln(b2/a1)/\sqrt{\epsilon_r}$$

while K represents the impedance ratio, $\epsilon_r$ represents the dielectric constant of the dielectric member.

The Q value is given by:

$$1/Q = 1/Q_c + \tan\delta$$

where $\tan\delta$ represents the dielectric loss. The value $Q_c$ is given as follows:

$$Q_c = \frac{b_1A_1\ln(1.2b_1/a_1) + A_2B_2\ln(b_2/a_1)}{\delta\,[A_1\{1 + (b_1/a_1)\} + A_2B_2\{(b_1/b_2) + (b_1/a_1)\} + (8\pi\sqrt{\epsilon_r}\, b_1/\lambda_0)\{\ln(1.2b_1/a_1) + B_1\ln(b_1/b_2)\}]}$$

where, $$A_1 = 2\beta L_1 + \sin 2\beta L_1,\ B_1 = \cos^2\beta L_1$$

$$A_2 = \beta L_2 - \sin 2\beta L_1,\ B_2 = \cos^2\beta L_1/\sin^2\beta L_2$$

where, $\delta$ represents the thickness of the surface layer.

Figure 6:
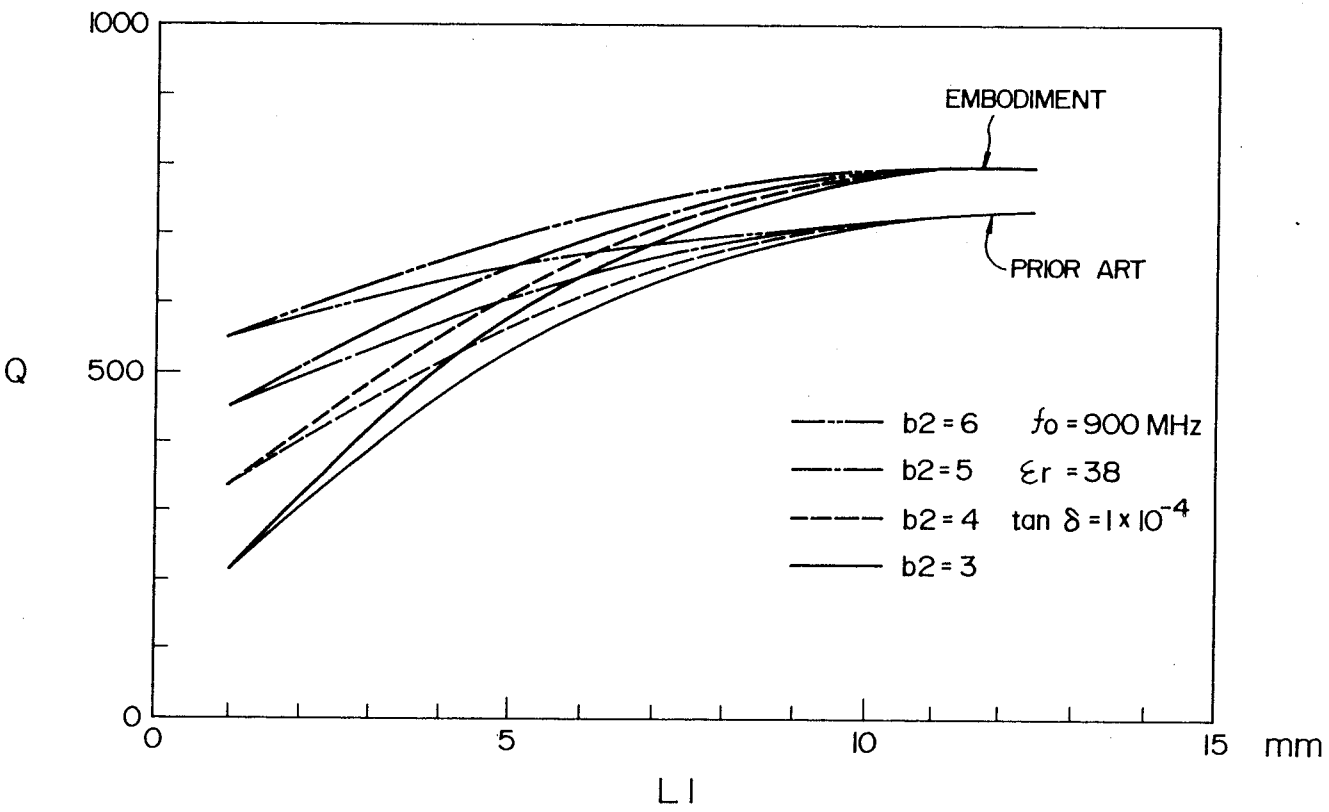
FIG. 6 is a characteristic curve showing the relationship between a ratio Q and a length $L_1$ with parameters of resonance frequency and band width.
Figure 9:
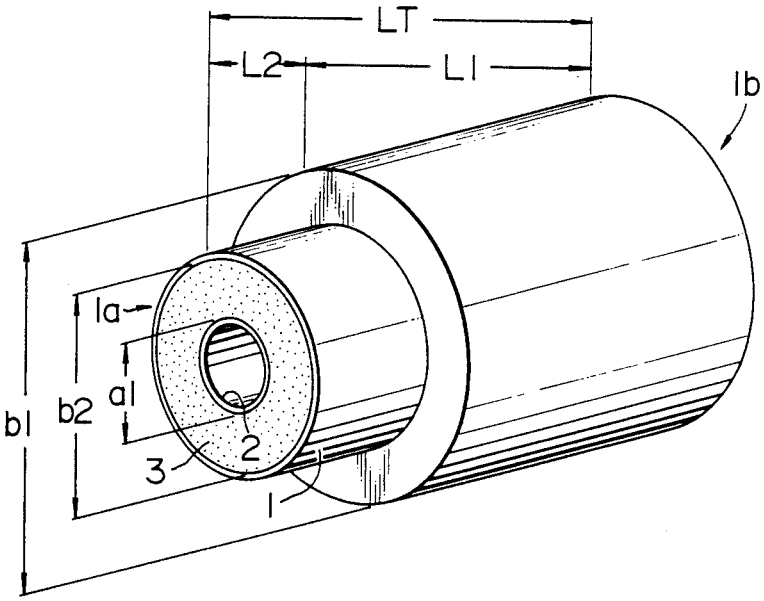
FIG. 9 is a perspective view of a known dielectric S.I.R.

The Q values were calculated on the conventional dielectric S.I.R. of FIG. 9 and the dielectric S.I.R. of this embodiment, while varying $L_1$ and $b_2$, the results of which are shown in FIG. 6.

Table 1 shows the dimensions and numerical data of the conventional dielectric S.I.R. employed in the calculations of FIG. 6, while Table 2 shows those of the dielectric S.I.R. of the first embodiment, employed in the calculations.

From FIG. 6 and Tables 1 and 2, it will be understood that the deterioration of the Q value can remarkably be suppressed by the present invention as compared with the conventional dielectric S.I.R.

TABLE 1

| NO | $a_1$ | $b_2$ | $b_1$ | $L_1$ | K | Q | Spurious Resonance Frequency |
|---|---|---|---|---|---|---|---|
| 1 | 2 | 7 | 8 | 6 | 0.90 | 680 | $3.06f_0$ |
| 2 | 2 | 6 | 8 | 6 | 0.79 | 630 | $3.31f_0$ |
| 3 | 2 | 5 | 8 | 7 | 0.66 | 665 | $3.50f_0$ |
| 4 | 2 | 4 | 8 | 8 | 0.50 | 630 | $3.38f_0$ |

TABLE 2

| NO | $a_1$ | $b_2$ | $b_1$ | $l_1$ | K | Q | Spurious Resonance Frequency |
|---|---|---|---|---|---|---|---|
| 1 | 2 | 7 | 8 | 6 | 0.80 | 730 | $3.28f_0$ |
| 2 | 2 | 6 | 8 | 6 | 0.70 | 685 | $3.50f_0$ |
| 3 | 2 | 5 | 8 | 7 | 0.58 | 715 | $3.66f_0$ |
| 4 | 2 | 4 | 8 | 8 | 0.44 | 690 | $3.51f_0$ |

Referring to FIG. 6, the impedance ratio K of the conventional dielectric S.I.R. is calculated to be K=0.66, when the dimensions and the dielectric constant are selected to be $b_1$=8 mm, $b_2$5 mm, $a_1$=2 mm and $\epsilon_r$=38.

On the other hand, the impedance ratio K of the dielectric S.I.R. of this embodiment is calculated as K=0.58 on condition of $b_1$=8 mm, $b_2$=5 mm, $a_1$=2 mm and $\epsilon_r$=38.

It will be understood that the dielectric S.I.R. of the invention provides a smaller impedance ratio K as compared with the conventional dielectric S.I.R.

As a matter of fact, a smaller impedance ratio K provides a greater suppression of the spurious resonance frequency. Thus, the described embodiment provides a greater suppression of the spurious resonance frequency ($f_s$) than the conventional dielectric S.I.R.

Figure 2:
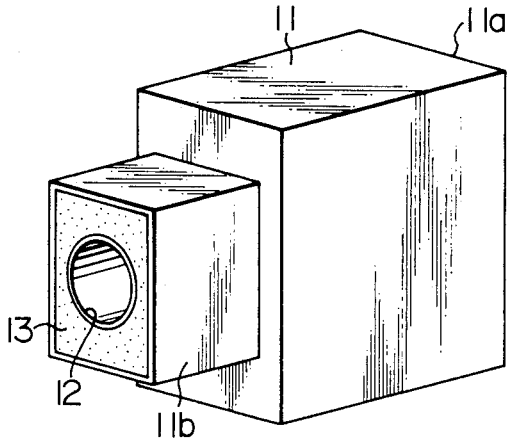
FIG. 2 is a perspective view of another embodiment of the dielectric S.I.R. in accordance with the present invention.

Although in FIG. 1 the open end portion 116 of the outer conductor 11 has a cylindrical form, this is not exclusive and the outer end portion **11*b* of the outer conductor 11 can have a prism form as shown in FIG. 2**.

FIGS. **3*a* and 3*b* show another embodiment of the invention. In these Figures, the same reference numerals are used to denote the same parts or members as those used in the first embodiment, and detailed description of such parts or members is omitted. This embodiment is characterized in that the inside diameter of the open end portion 12*a* of the inner conductor, having a predetermined axial length from the end extremity, is determined to be greater than that of the closed end of the inner conductor 12. On the other hand, the outer conductor 11** has a constant outer diameter over its entire length.

Figure 4A:
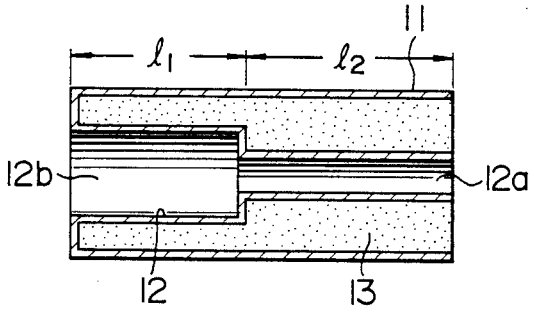
FIG. 4*a* and 4*b* are a sectional view and a right end view of a different embodiment of the dielectric S.I.R. of the present invention.
Figure 4B:
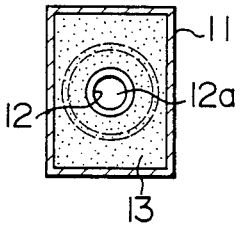

FIG. 4 shows a different embodiment in which the relationship between the inside diameters of both ends of the inner conductor 12 are reversed from that of the embodiment shown in FIGS. **3*a* and 3*b***.

Figure 3A:
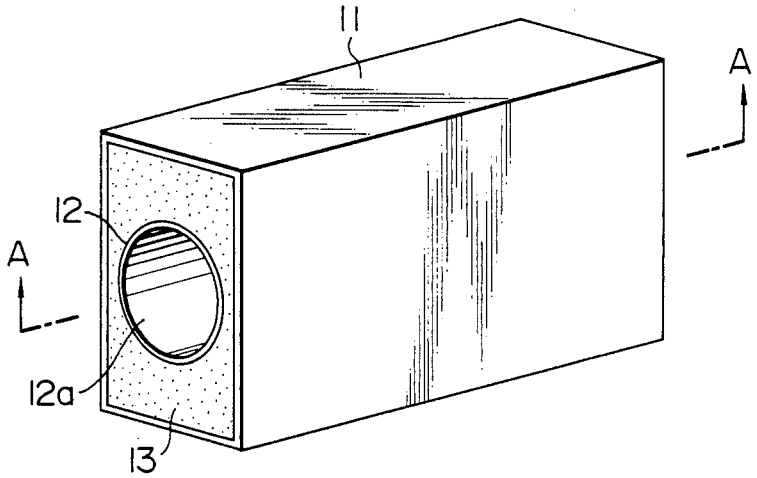
FIGS. 3*a* and 3*b* are a perspective view and a sectional view of still another embodiment of the dielectric S.I.R. of the present invention.
Figure 3B:
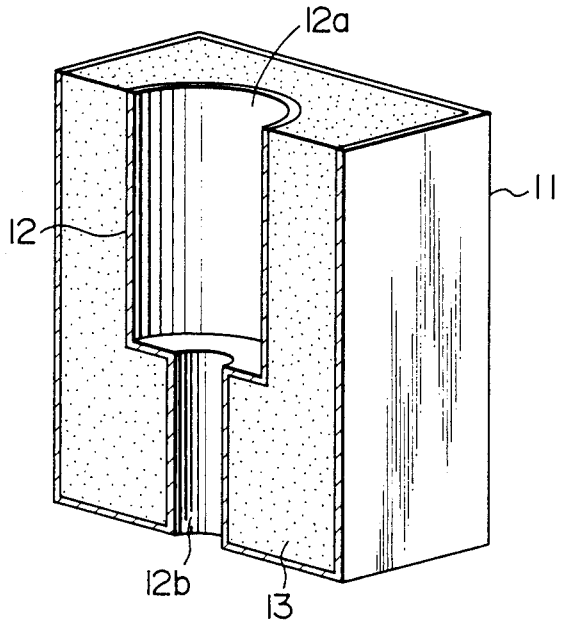

FIGS. **5*a* and 5*b* show a different embodiment in which the open end portion 12*a* of the inner conductor 12 has a prism form, unlike the embodiment shown in FIGS. 3*a* and 3*b***.

Figure 5A:
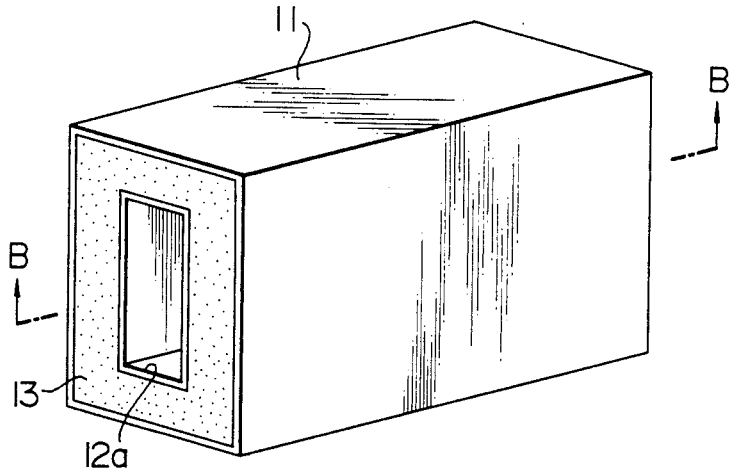
FIGS. 5*a* and 5*b* are a perspective view and a sectional view of a different embodiment of the dielectric S.I.R. of the present invention.
Figure 5B:
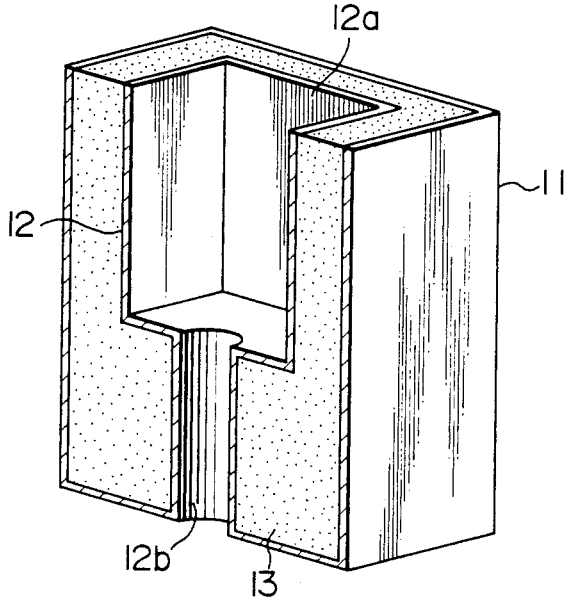

The embodiments shown in FIGS. **3*a*, 3*b* to FIGS. 5*a* and 5*b*** produce effects substantially equivalent to those produced by the first embodiment.

As has been described, according to the present invention, the closed end portion of the outer conductor has a prism form, while the open end portion of the outer conductor has a cylindrical or a prism form with outer dimension smaller than that of the closed end. Alternatively, the open end portion of the inner conductor has a cylindrical or prism form with a greater inner diameter. With this arrangement, it is possible to reduce deterioration of the Q value so as to provide a greater effect of suppression of the spurious characteristics of the dielectric S.I.R.

By using the dielectric S.I.R. of the present invention, therefore, it is possible to obtain a filter which does not suffer from a reduced insertion loss and which exhibits a significantly improved spurious characteristics, thus offering a great advantage from an industrial point of view.

A description will be given of a 2-staged band-pass filter incorporating a dielectric S.I.R. of the present invention.

Figure 10A:
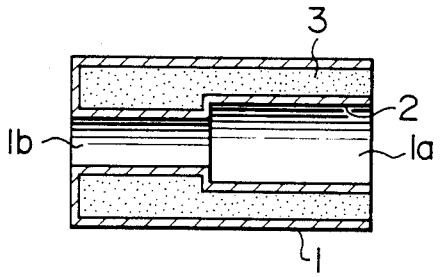
FIG. 10a PRIOR ART
FIGS. 10*a* and 10*b* are a sectional view and a side elevational view of another known dielectric S.I.R.
Figure 10B:
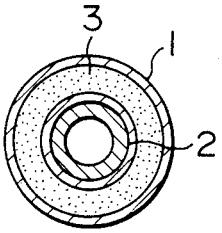
FIG. 10b PRIOR ART

FIGS. *7a* and *7b* show a filter which incorporates a conventional dielectric S.I.R. of the type shown in FIG. 10, having a diameter of 10 mm.

FIGS. *8a* and *8b* show a filter incorporating the dielectric S.I.R. of the invention shown in FIG. 3, having outside dimensions of 10 mm and 8 mm. In FIGS. *7a* to FIG. *8b*, numerals 50 and 60 denote, respectively, coupling capacitors, while 51 and 61 denote dielectric members. The outer and inner conductors are denoted by 52, 62 and 58, 68, respectively. Numerals 54, 64 denote steps, while 55 and 65 denote connectors. Numerals 55 and 56 denote cases, while 57 and 67 denote solder terminals. The resonator element used in the filters of FIGS. *7a* to *8b* have the same value of Q so that they exhibit the same characteristics at the fundamental frequencies. The primary spurious characteristics, outer dimensions and the volume of these filters are shown in Table 3. From this Table, it will be understood that the volume of the filter shown in FIGS. *8a* and *8b* is reduced in amount of about 18% as compared with the conventional filter of FIGS. *7a* and *7b*, though the spurious characteristics of both filters are materially the same.

Figure 7A:
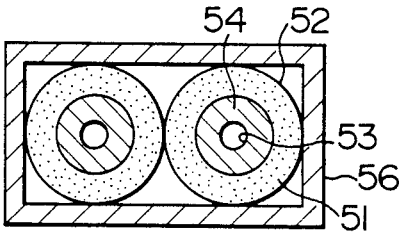
FIG. 7a PRIOR ART
FIGS. 7*a* and 7*b* are a cross-sectional view and a longitudinal sectional view of a band-pass filter making use of a known dielectric S.I.R.
Figure 7B:
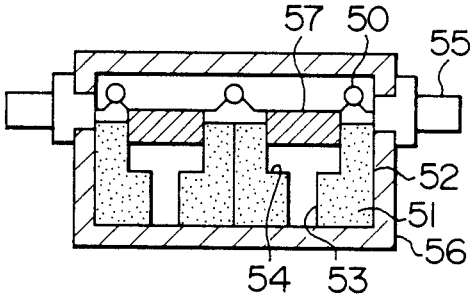
FIG. 7b PRIOR ART
Figure 8A:
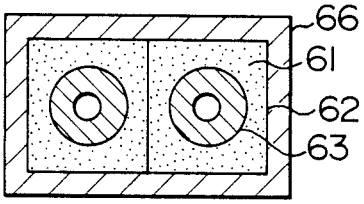
FIGS. 8*a* and 8*b* are a cross-sectional view and a longitudinal sectional view of a band-pass filter making use of the dielectric S.I.R. of FIG. 3.
Figure 8B:
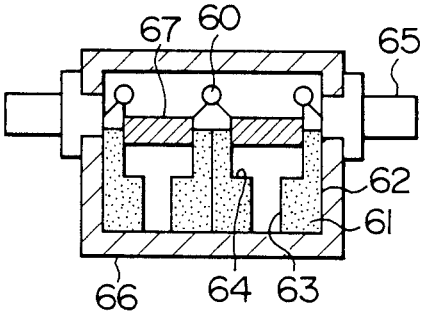

| | FIGS. 7a, 7b | FIGS. 8a, 8b |
|---|---|---|
| Primary Spurious Frequency | $3.9 \times f_0$ | $3.9 \times f_0$ |
| Outer dimensions | Width × Depth × Height<br>26mm × 16mm × 11.5mm | Width × Depth × Height<br>22mm × 16mm × 11.5mm |
| Volume | 4.9cc | 4.0cc |

$f_0$ fundamental frequency

As will be understood from the foregoing description, according to the present invention, it is possible to freely set the spurious resonance frequency by virtue of the provision of a step in the hollow of the dielectric S.I.R. incorporated in the filter.

The invention also offers the following advantages:

(1) Space factor us significantly improved so as to enable the size of the product to be reduced.

Namely, wasteful or dead space is minimized by virtue of the prism form of the outer conductor.

In addition, resonators having variety of operation characteristics can be obtained by changing the length of one side of the prism form, so that the degree of freedom of design can be enhanced with a constant width.

(2) The no-load Q value is increased as compared with conventional cylindrical resonator having an equal volume.

Thus, the present invention enables dielectric S.I.R.s to be designed to have variety of operation characteristics adaptable to wide variety of use, thus offering a significantly increased degree of freedom in design as compared with conventional resonators which have cylindrical configurations. In addition, the dielectric S.I.R.s of the present invention can easily be mass-produced, thus offering a great advantage from an industrial point of view.

What is claimed is:

1. A coaxial dielectric resonator comprising:

a dielectric member having an outer surface and a longitudinally extending aperture formed therethrough so as to define a inner surface, said dielectric member including a first portion and a second portion, said first portion having a cylindrical shape and defining a first end, and said second portion being prism-shaped and defining a second end providing a rectangular end face formed of four sides each having a length which is greater than an outer diameter of said first portion;

an outer conductor formed on said outer surface of said dielectric member;

an inner conductor formed on said inner surface of said dielectric member; and a short-circuiting member electrically interconnecting said outer conductor with said inner conductor at said second end.

2. A coaxial dielectric resonator comprising:

a dielectric member having an outer surface and a longitudinally extending aperture formed therethrough so as to define an inner surface, said dielectric member including a first portion and a second portion, said first portion being prism-shaped and defining a first end providing a first rectangular end face formed of four sides, and said second portion being prism-shaped and defining a second end providing a second end face formed of four sides corresponding to said four sides of said first rectangular end face, said four sides of said second rectangular end face having respective lengths which are longer than corresponding lengths of said corresponding sides of said first rectangular end face;

an outer conductor formed on said outer surface of said dielectric member;

an inner conductor formed on said inner surface of said dielectric member; and a short-circuiting member electrically interconnecting said outer conductor with said inner conductor at said second end.

3. A coaxial dielectric resonator comprising:

a dielectric member having an outer surface and a longitudinally extending aperture formed therethrough so as to define and inner surface, said aperture having a rectangular cross-sectional shape, said dielectric member having a first end and a second end, said aperture including a first portion and a second portion adjacent to said first portion, said first portion being positioned adjacent said first end and having a first cross-sectional dimension, and said second portion extending from said first portion to said second end and having a second cross-sectional dimension which is larger than said first cross-sectional dimension;

an outer conductor formed on said outer surface of said dielectric member;

an inner conductor formed on said inner surface of said dielectric member; and a short-circuiting member electrically interconnecting said outer conductor with said inner conductor at said second end.

* * * * *